US006435504B1

(12) United States Patent
Nightingale

(10) Patent No.: US 6,435,504 B1
(45) Date of Patent: Aug. 20, 2002

(54) METHOD OF PLAYING A SPELLING GAME

(76) Inventor: Fred M. Nightingale, 9408 Lakeview Dr., Cadillac, MI (US) 49601

( * ) Notice: Subject to any disclaimer, the term of this patent is extended or adjusted under 35 U.S.C. 154(b) by 0 days.

(21) Appl. No.: 09/860,325

(22) Filed: May 18, 2001

(51) Int. Cl.[7] ..... A63F 3/00
(52) U.S. Cl. ..... 273/272; 273/146; 434/172
(58) Field of Search ..... 273/272, 299, 273/146; 434/171, 172

(56) References Cited

U.S. PATENT DOCUMENTS 1,684,609 A * 9/1928 Walker
2,491,883 A * 12/1949 Welch
3,670,427 A * 6/1972 Stolpen
3,959,893 A 6/1976 Sigg
4,055,348 A * 10/1977 Marzoni
4,452,588 A 6/1984 Smith
D283,632 S 4/1986 Moore
4,592,553 A 6/1986 Mammen et al.
4,966,366 A * 10/1990 Mercado-Torres
5,176,381 A 1/1993 Winters
5,558,328 A 9/1996 Krantz

* cited by examiner

*Primary Examiner*—William M. Pierce

(57) ABSTRACT

A method of playing a spelling game for improving a user's spelling abilities while having fun. The method of playing a spelling game includes a plurality of game pieces. Each of the game pieces includes a plurality of surfaces. Providing. at least one letter indicia marked on each of the surfaces of each of the game pieces. At least one player rolling the plurality of game pieces to generate a plurality of the letter indicia. The player combining the letter indicia on each of the game pieces to generate a plurality of words. Winning the spelling game by achieving a predetermined number of the words.

10 Claims, 3 Drawing Sheets

METHOD OF PLAYING A SPELLING GAME

BACKGROUND OF THE INVENTION

1. Field of the Invention

The present invention relates to games and more particularly pertains to a new method of playing a spelling game for improving a user's spelling abilities while having fun.

2. Description of the Prior Art

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,592,553; U.S. Pat. No. 4,452,588; U.S. Pat. No. 5,176,381; U.S. Pat. No. 3,959,893; U.S. Pat. No. Des. 283,632; and U.S. Pat. No. 5,558,328.

While these devices fulfill their respective, particular objectives and requirements, the aforementioned patents do not disclose a new method of playing a spelling game. The inventive device includes providing a plurality of game pieces. Each of the game pieces includes a plurality of surfaces. Providing at least one letter indicia marked on each of the surfaces of each of the game pieces. At least one player rolling the plurality of game pieces to generate a plurality of the letter indicia. The player combining the letter indicia on each of the game pieces to generate a plurality of words. Winning the spelling game by achieving a predetermined number of the words.

In these respects, the method of playing a spelling game according to the present invention substantially departs from the conventional concepts and designs of the prior art, and in so doing provides an apparatus primarily developed for the purpose of improving a user's spelling abilities while having fun.

SUMMARY OF THE INVENTION

In view of the foregoing disadvantages inherent in the known types of games now present in the prior art, the present invention provides a new method of playing a spelling game construction wherein the same can be utilized for improving a user's spelling abilities while having fun.

The general purpose of the present invention, which will be described subsequently in greater detail, is to provide a new method of playing a spelling game apparatus and method which has many of the advantages of the games mentioned heretofore and many novel features that result in a new method of playing a spelling game which is not anticipated, rendered obvious, suggested, or even implied by any of the prior art games, either alone or in any combination thereof.

To attain this, the present invention generally comprises a plurality of game pieces. Each of the game pieces includes a plurality of surfaces. Providing at least one letter indicia marked on each of the surfaces of each of the game pieces. At least one player rolling the plurality of game pieces to generate a plurality of the letter indicia. The player combining the letter indicia on each of the game pieces to generate a plurality of words. Winning the spelling game by achieving a predetermined number of the words.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new method of playing a spelling game apparatus and method which has many of the advantages of the games mentioned heretofore and many novel features that result in a new method of playing a spelling game which is not anticipated, rendered obvious, suggested, or even implied by any of the prior art games, either alone or in any combination thereof.

It is another object of the present invention to provide a new method of playing a spelling game which may be easily and efficiently manufactured and marketed.

It is a further object of the present invention to provide a new method of playing a spelling game which is of a durable and reliable construction.

An even further object of the present invention is to provide a new method of playing a spelling game which is susceptible of a low cost of manufacture with regard to both materials and labor, and which accordingly is then susceptible of low prices of sale to the consuming public, thereby making such method of playing a spelling game economically available to the buying public.

Still yet another object of the present invention is to provide a new method of playing a spelling game which provides in the apparatuses and methods of the prior art some of the advantages thereof, while simultaneously overcoming some of the disadvantages normally associated therewith.

Still another object of the present invention is to provide a new method of playing a spelling game for improving a user's spelling abilities while having fun.

Yet another object of the present invention is to provide a new method of playing a spelling game which includes a plurality of game pieces. Each of the game pieces includes a plurality of surfaces. Providing at least one letter indicia marked on each of the surfaces of each of the game pieces. Providing at least one player rolling the plurality of game pieces to generate a plurality of the letter indicia. The player combining the letter indicia on each of the game pieces to generate a plurality of words. Winning the spelling game by achieving a predetermined number of the words.

Still yet another object of the present invention is to provide a new method of playing a spelling game that helps users improve their spelling abilities.

Even still another object of the present invention is to provide a new method of playing a spelling game that is fun and entertaining for users of all ages.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
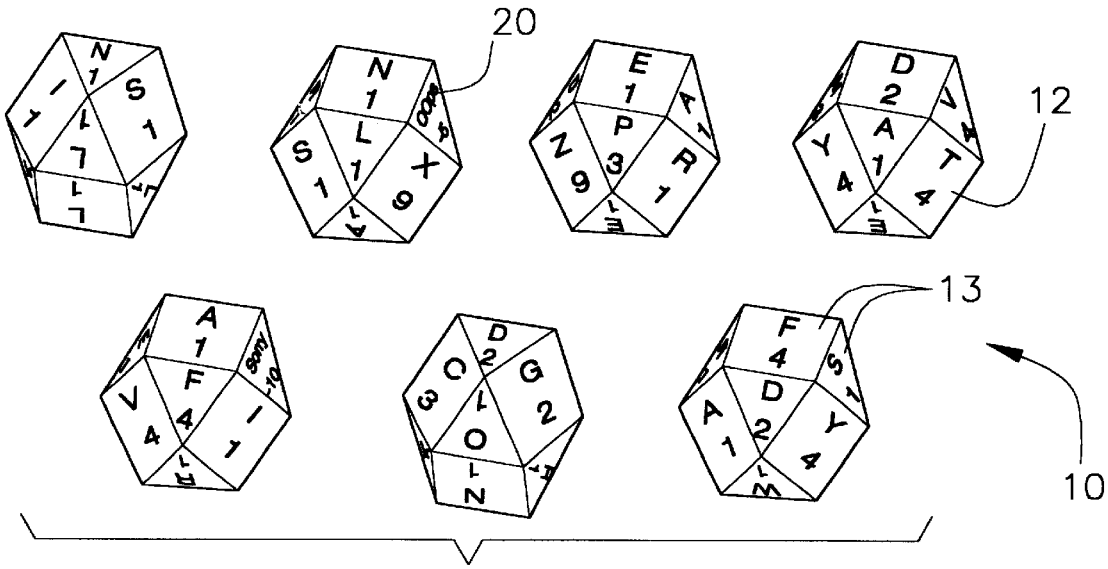
FIG. 1 is a schematic perspective view of a new method of playing a spelling game according to the present invention.
Figure 2:
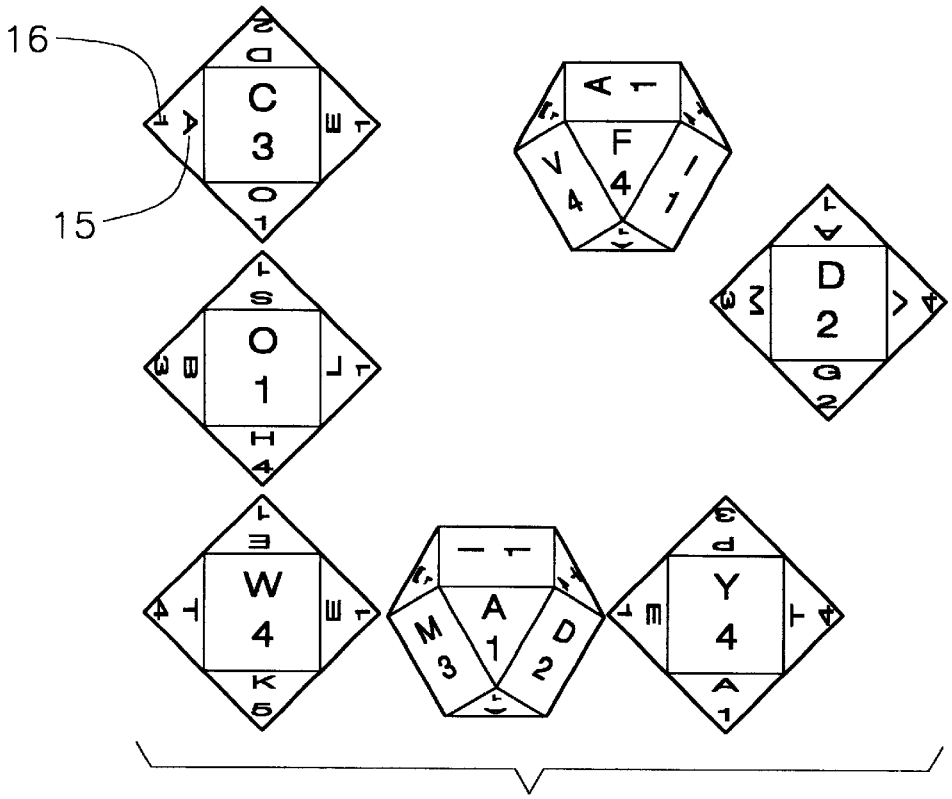
FIG. 2 is a schematic perspective view of the present invention showing a plurality of game pieces.
Figure 3A:
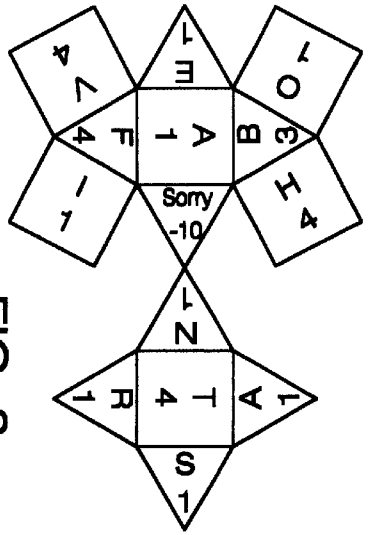
FIG. 3*a* is, a schematic frontal view of the present invention showing all the surfaces of one of the game pieces.
Figure 3B:
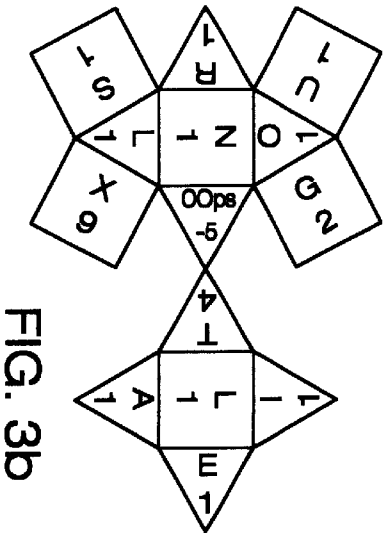
FIG. 3*b* is a schematic frontal view of the present invention.
Figure 3C:
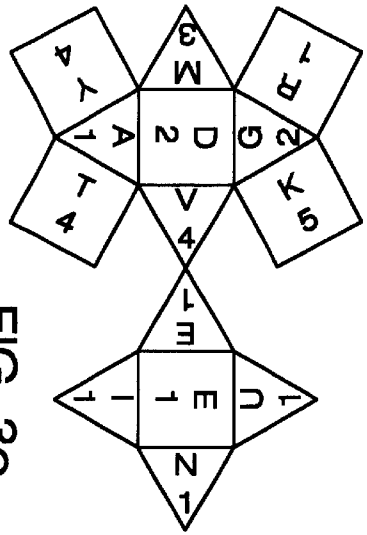
FIG. 3*c* is a schematic frontal view of the present invention.
Figure 3D:
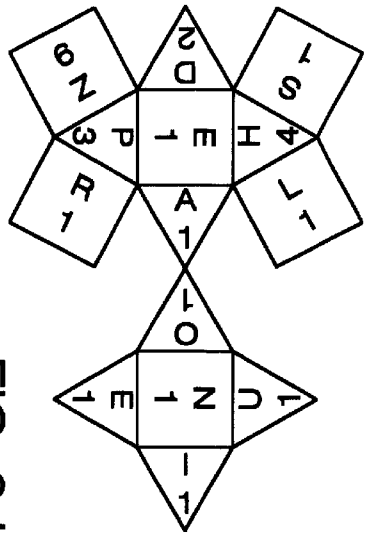
FIG. 3*d* is a schematic frontal view of the present invention.
Figure 3E:
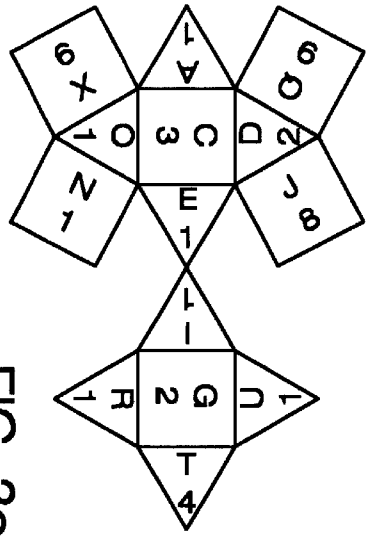
FIG. 3*e* is a schematic frontal view of the present invention.
Figure 3F:
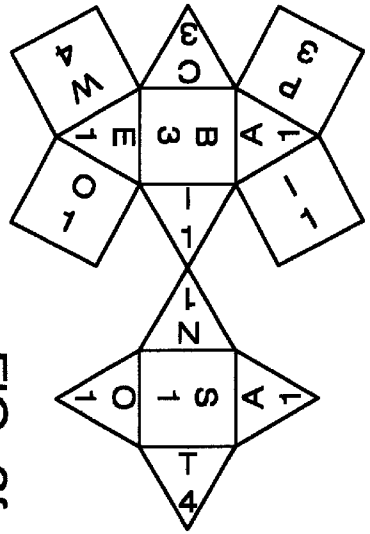
FIG. 3*f* is a schematic frontal view of the present invention.
Figure 3G:
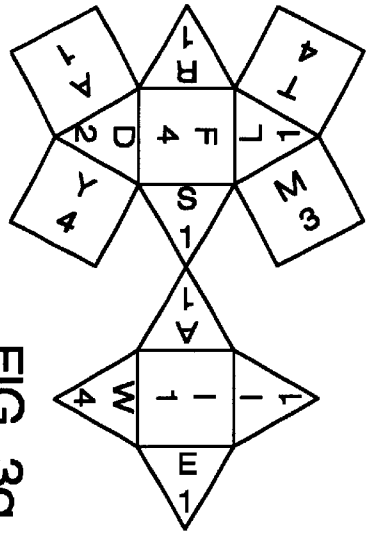
FIG. 3*g* is a schematic frontal view of the present invention.
Figure 4:
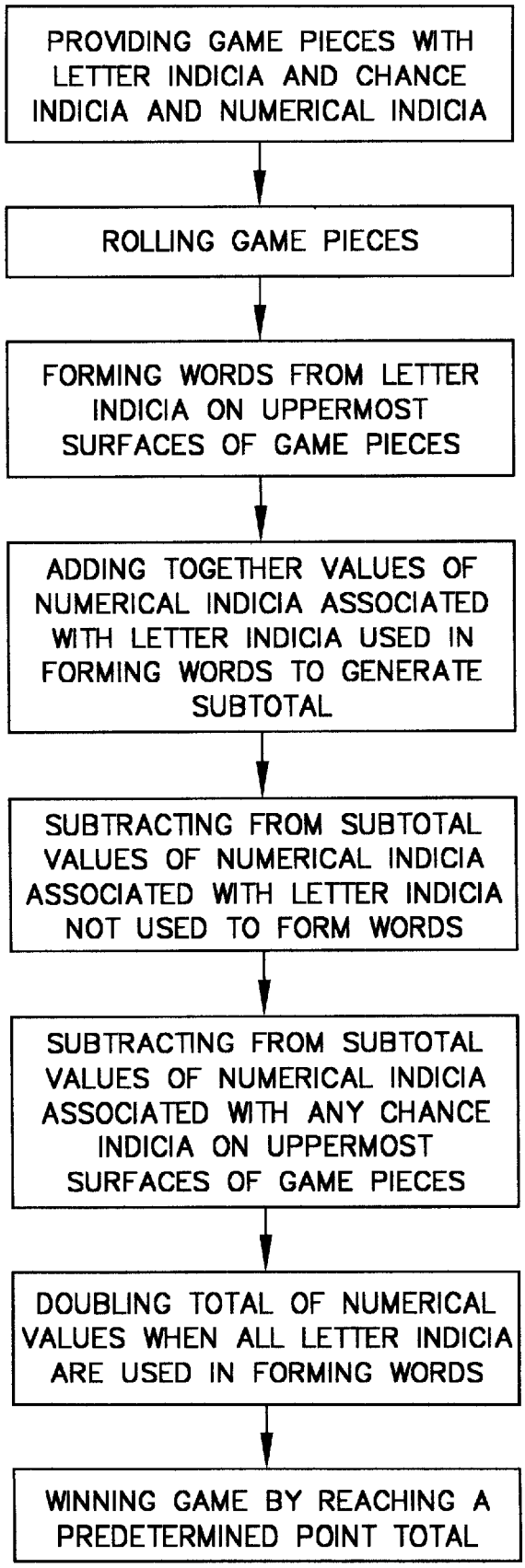
FIG. 4 is a schematic flowchart of the method of playing the game of the present invention.

With reference now to the drawings, and in particular to FIGS. 1 through 3*g* thereof, a new method of playing a spelling game embodying the principles and concepts of the present invention and generally designated by the reference numeral 10 will be described.

As best illustrated in FIGS. 1 through 3*g*, the method of playing a spelling game 10 generally comprises providing a plurality of game pieces 12. Each of the game pieces 12 may include a generally spherical shape with a plurality of surfaces 13. Each of the surfaces 13 is preferably positioned generally adjacent to each other. Each of the surfaces 13 may include a generally triangular shape, however, other shapes may be employed. Each of the game pieces 12 may have approximately fourteen surfaces. The game may use a total of seven game pieces 12, however, other any number of game pieces 12 may be employed. Each of the game pieces 12 may comprise a substantially rigid material such as, for example, a wood or plastic material.

The method of playing a spelling game 10 additionally includes providing at least one letter indicia 15 marked on each of the surfaces 13 of each of the game pieces 12. Each of the letter indicia 15 may correspond to a letter in an alphabet. The game may employ letters from any alphabet such as, for example, an English, French or German alphabet.

The game may also include providing at least one chance indicia 20 marked on at least one of the surfaces 13 of at least one of the game pieces 12. The chance indicia 20 may comprise a word such as, for example, oops or sorry.

The method of playing a spelling game 10 may include providing at least one numerical indicia 16 marked on each of the surfaces 13 of each of the game pieces 12 in order to provide a numerical value to each of the letter indicia 15. The numerical indicia 16 may be positioned generally adjacent to the letter indicia 15.

In use, at least one player determines a numerical indicia 16 value to be achieved by the players while playing the game. One of the players rolls the plurality of game pieces 12 to generate a plurality of the letter indicia 15 and corresponding numerical indicia 16. The numerical indicia 16 is added together to generate a subtotal. The players observe the letter indicia 15 on the surfaces 13 of the game pieces 12 parallel to a playing surface. Each of the players then combines the letter indicia 15 on each of the game pieces 12 to generate their own plurality of words.

Each of the players may subtract from the subtotal the numerical indicia 16 corresponding to each of the letter indicia 15 not used in generating each of the words. The players may subtract the numerical indicia 16 corresponding to the chance indicia 20 from the subtotal numerical indicia value calculated by adding and subtracting the numerical indicia 16. One of the players wins the game by achieving the predetermined numerical value. If any of the players use all of the letter indicia 15 on each of the game pieces 12 that player is allowed to double the total numerical value obtained on that roll of the game pieces 12. The game may include a plurality of players. The game is designed such that it may be played by a single player.

The letter indicia 15 and numerical indicia 16 may correspond according to the following chart:

| Block 1 | Block 2 | Block 3 | Block 4 | Block 5 | Block 6 | Block 7 |
|---|---|---|---|---|---|---|
| A = 1 | B = 3 | C = 3 | D = 2 | E = I | F = 4 | G = 2 |
| H = 4 | I = 1 | J = 8 | K = 5 | L = 1 | M = 3 | N = 1 |
| O = 1 | P = 3 | Q = 9 | R = 1 | S = 1 | T = 4 | U = 1 |
| V = 4 | W = 4 | X = 9 | Y = 4 | Z. = 9 | A = 1 | S = 1 |
| I = 1 | O = 1 | N = 1 | T = 4 | R = 1 | Y = 4 | X = 9 |
| T = 4 | S = 1 | G = 2 | E = 1 | N = 1 | I = 1 | L = 1 |
| B = 3 | A = 1 | D = 2 | G = 2 | H = 4 | L = 1 | O = 1 |
| E = I | C = 3 | A = 1 | M = 3 | D = 2 | R = 1 | L = 1 |
| F = 4 | E = 1 | O = 1 | A = 1 | P = 3 | D = 2 | R = I |
| N = 1 | I = 1 | E = 1 | V = 4 | A = I | S = 1 | OOPS = −5 |
| R = 1 | N = 1 | I = 1 | E = 1 | O = 1 | A = 1 | T = 4 |
| S = 1 | O = 1 | R = 1 | I = 1 | E = 1 | W = 4 | A = 1 |
| SORRY = −10 | T = 4 | T = 4 | N = 1 | I = 1 | E = 1 | I = 1 |

-continued

| Block 1 | Block 2 | Block 3 | Block 4 | Block 5 | Block 6 | Block 7 |
|---|---|---|---|---|---|---|
| A = 1 | Q = 1 | U = 1 | U = 1 | U = 1 | I = 1 | E = 1 |

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a spelling game for at least one player comprising the steps of:

providing a plurality of game pieces, each of said game pieces having a plurality of surfaces, at least one letter indicia being marked on each of said surfaces of each of said game pieces, at least one numerical point indicia being marked on each of said surfaces of each of said game pieces for providing a numerical point value corresponding to said each of said letter indicia;

rolling said plurality of game pieces by said at least one player to generate a plurality of said letter indicia;

combining said letter indicia on each of said game pieces to generate a plurality of words;

adding each of said numerical point indicia corresponding to each of said letter indicia used in generating each of said words to generate a point subtotal;

subtracting from said point subtotal each of said numerical point indicia corresponding to each of said letter indicia not used in generating each of said words; and winning said spelling game by said at least one player achieving a predetermined number of points.

2. The method of playing a spelling game of claim 1, wherein a portion of said plurality of surfaces each have a generally triangular shape.

3. The method of playing a spelling game of claim 1, wherein each of said letter indicia corresponds to a letter in an alphabet.

4. The method of playing a spelling game of claim 1, additionally including the step of providing at least one chance indicia being marked on at least one surface of at least one of said game pieces.

5. The method of playing a spelling game of claim 4, wherein said chance indicia comprises a word.

6. The method of playing a spelling game of claim 5, additionally including the step of subtracting from said point subtotal each of said numerical indicia corresponding to said chance indicia when said chance indicia appears on an uppermost one of said surfaces of one of said game pieces.

7. The method of playing a spelling game of claim 1, additionally including the step of determining a numerical indicia value to be achieved by said player.

8. The method of playing a spelling game of claim 1, additionally including the step of doubling a total numerical point value obtained by said player using all of said letter indicia on each of said game pieces in generating one or more words.

9. The method of playing a spelling game of claim 1, additionally including the step of:

providing a plurality of players, each of said players rolling said plurality of game pieces.

10. A method of playing a spelling game comprising the steps of:

providing a plurality of game pieces, each of said game pieces having a plurality of surfaces, each of said surfaces being positioned generally adjacent to each other, a portion of said plurality of surfaces each having a generally triangular shape, each of said game pieces comprising a substantially rigid material;

providing at least one letter indicia being marked on each of said surfaces of each of said game pieces, each of said letter indicia corresponding to a letter in an alphabet;

providing at least one chance indicia being marked on at least one of said surfaces of at least one of said game pieces, said chance indicia comprising a word;

providing at least one numerical indicia being marked on each of said surfaces of each of said game pieces for providing a numerical point value to each of said letter indicia and said chance indicia, said numerical indicia being positioned generally adjacent to said letter indicia and said chance indicia, rolling said plurality of game pieces by one of a plurality of players to generate a plurality of said letter indicia and corresponding said numerical indicia, each of said players observing said letter indicia on said surfaces of said game pieces parallel to a playing surface, each of said players combining said letter indicia on each of said game pieces to generate a plurality of words;

determining a numerical point value to be achieved by said players;

adding together each of said numerical indicia corresponding to each of said letter indicia used in generating each of said words to generate a point subtotal;

subtracting from said point subtotal each of said numerical indicia corresponding to each of said letter indicia not used in generating each of said words;

subtracting from said subtotal each of said numerical indicia corresponding to said chance indicia when said chance indicia appears on an uppermost one of said surfaces of one of said game pieces;

doubling a total numerical value obtained by one of said players using all of said letter indicia on each of said game pieces in generating one or more words; and winning said spelling game by first of said players to achieve said predetermined numerical point value.

* * * * *